United States Patent [19]

Volpi

[11] 4,303,266

[45] Dec. 1, 1981

[54] ENTRY IMPEDIENT DEVICE

[76] Inventor: Harry Volpi, 1935 Humboldt, Reno, Nev. 89509

[21] Appl. No.: 102,159

[22] Filed: Dec. 10, 1979

[51] Int. Cl.[3] ..... E05C 1/12

[52] U.S. Cl. ..... 292/166; 292/DIG. 15

[58] Field of Search ..... 292/166, 173, 335, DIG. 15, 292/153

[56] References Cited

U.S. PATENT DOCUMENTS

| | | | |
|---|---|---|---|
| 1,271,363 | 7/1918 | Ralston | 292/DIG. 15 X |
| 1,866,233 | 7/1932 | Tarrant | 292/166 X |
| 1,895,146 | 1/1933 | Brown | 292/DIG. 15 X |
| 2,291,402 | 7/1942 | Miller | 292/166 |
| 3,621,686 | 11/1971 | Klein | 292/335 X |
| 3,805,322 | 4/1974 | Serrano | 292/DIG. 15 X |

FOREIGN PATENT DOCUMENTS

| | | | |
|---|---|---|---|
| 3664 | of 1890 | United Kingdom | 292/166 |

*Primary Examiner*—Richard E. Moore

*Attorney, Agent, or Firm*—Mark C. Jacobs

[57] ABSTRACT

Door opening prevention apparatus which is adapted to be installed in the floor in a door opening whereby a door opening impeding device is released when someone steps on the apparatus to prevent opening of the door until the device is returned to its inactive position.

8 Claims, 9 Drawing Figures

ENTRY IMPEDIENT DEVICE

BACKGROUND OF THE INVENTION

1. Field of the Invention

The invention relates to door opening prevention apparatus, and, more particularly, to apparatus which is mounted in the floor of a door opening to prevent unauthorized opening of the door when actuated.

2. Description of the Prior Art

There has always been a need for security devices to prevent unauthorized entry into a house or the like. Generally, such devices are relatively complicated and expensive and difficult to install. There is a need for a relatively inexpensive and uncomplicated device which can be quickly and easily installed in a location whereby a door into a house or the like cannot be opened easily even if an intruder has a key to the door. Such a device should be mounted in a manner whereby it can be easily avoided by the homeowner but located such that it is activated unknowingly by an intruder. Such a device should be able to be installed by a homeowner who is relatively unskilled and without the need for complicated and expensive tooling. It is intended primarily for inward opening entry doors.

SUMMARY OF THE INVENTION

It is an object of this invention to provide a device which can be installed in a door opening to prevent unauthorized entry.

It is a further object of this invention to provide apparatus installed in a door opening which releases a door opening impeding device when actuated.

These and other objects are preferably accomplished by providing an impeding device which is installed in a door opening, which is released when someone steps on it, and prevents opening of the door until the device is returned to its original position.

DESCRIPTION OF THE PREFERRED EMBODIMENT

Figure 1:
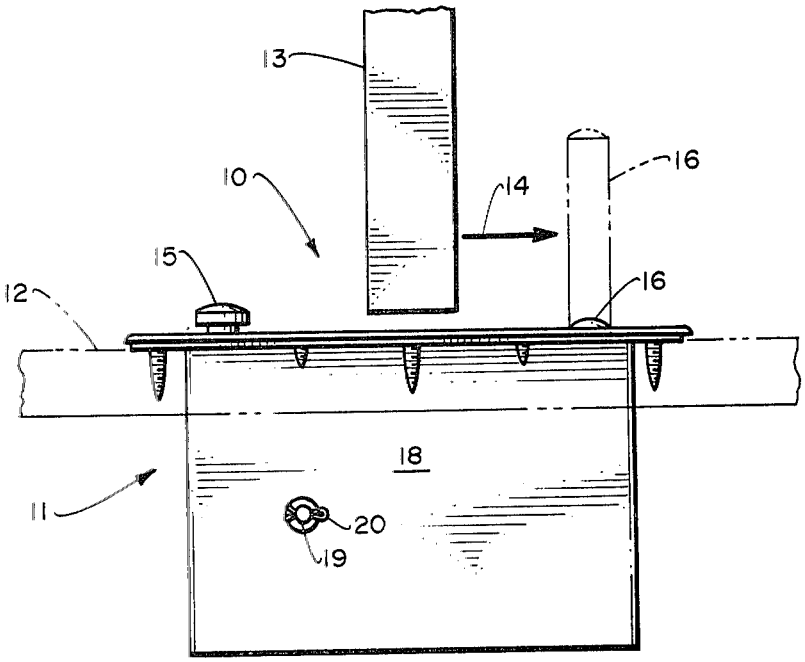
FIG. 1 is a schematic view, partly in cross-section, of a device in accordance with the teachings of the invention installed in a door opening.

Referring now to FIG. 1 of the drawing, door opening preventing apparatus 10 is shown wherein device 11 is installed in the floor 12 below door 13. It is to be understood that door 13 is shown in the closed position in FIG. 1 and adapted to be opened in the direction of arrow 14.

As shown in FIG. 1, device 11 is in its normal inoperative position whereby door 13 can be freely opened and closed. Also, although door 13 opens in the direction of arrow 14, device 11 can be installed on the outside of the door opened in a direction opposite that of arrow 14. That is, device 11 would not straddle the underside of door 13 in FIG. 1 but be installed entirely on the outside thereof. In any event, button 15, as will be discussed, should be located in a position to be actuated by an intruder so that, when actuated, door impeding member 16 moves to the dotted line position in FIG. 1 (as will also be discussed) to prevent further opening of the door 13. However see FIG. 8 discussional.

It can be understood that device 11 can be any suitable dimensions to carry out the foregoing. Button 15 is located in the floor 12 at a location whereby, when stepped upon, releases member 16 to its dotted line position. The homeowner, of course, can avoid button 15 so door 13 is opened and closed freely. Button 15 may be covered by a mat or the like so it is not normally visible and set to release member 16 only upon the application of considerable weight, e.g., the normal weight of an intruder or the like.

Figure 2:
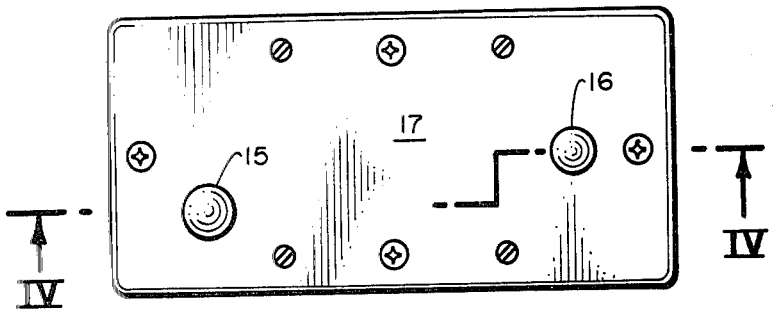
FIG. 2 is a top plan view of the device alone of the invention.

Device 11, and its operation, is illustrated in detail in FIGS. 2 through 7. In FIG. 2, an upper plate 17 is shown which normally closes off the top of housing 18 of FIG. 1. Housing 18 may be generally rectangular as shown on FIG. 3 having a cross pin 19 secured by nuts 20 having an elongated rod 21 welded to tube 60 which holds cross pin 19 at weld 22 (see FIG. 4). One end of rod 21 is fixedly secured to a movable piston rod 23 freely movable in a cylinder 24 mounted to side plate 18A. Cylinder 24 includes an elongated slot 25 (see FIG. 7) with rod 21 movable therein.

Referring again to FIG. 4, piston rod 23 includes an integral upper portion which forms the door opening impeding member 16 (rod 23 and member 16 may be one integral piece).

Figure 4:
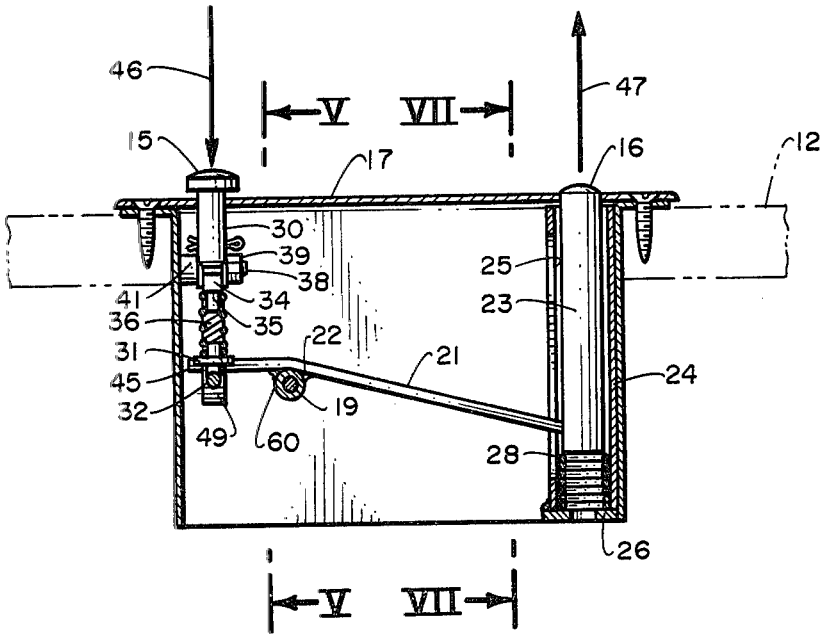
FIG. 4 is a vertical view taken along lines IV—IV of the device of FIG. 2.

A cross plate 26 (per FIG. 4 is welded to cylinder 24). A coil spring 28 rests on cross plate 26 inside the lower part of cylinder 24. The top part of spring 28 touches piston rod 23 and normally biases rod 23 upwardly to the dotted line position of member 16 in FIG. 1 on activiation of pin 15.

Figure 5:
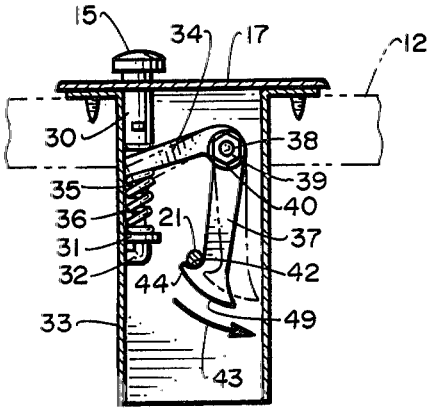
FIG. 5 is a view taken along lines V—V of FIG. 4.
Figure 6:
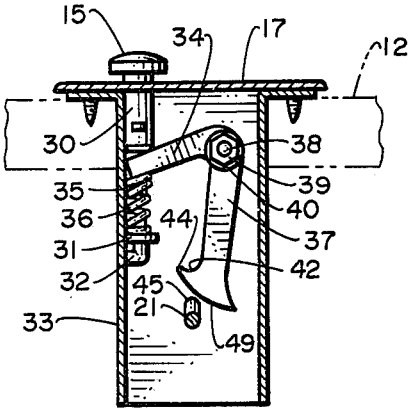
FIG. 6 is a view similar to FIG. 5 illustrating operation of the components thereof.

Looking now to FIGS. 4 and 5, button 15 if fixedly secured to an integral shaft 30 extending downwardly through a suitable aperture in top plate 17. A stop plate 31 is fixedly secured via flange 32 to side wall 33 of housing 18. Shaft 30 abuts at its lower end to the top of an elongated shaft 34 having a downwardly extending spring guide pin 35 with a coiled spring 36 surrounding pin 35. Spring 36 abuts at one end against plate 31 and at the other end against shaft 34. Spring 36 normally biases button 15 upwardly.

Figure 3:
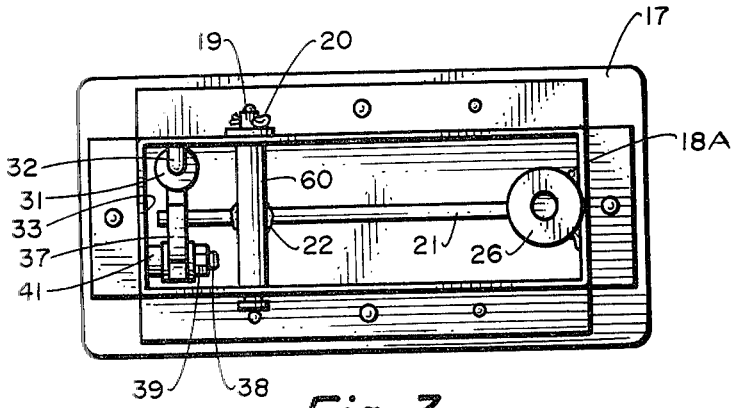
FIG. 3 is a bottom plan view of the device alone of the invention.

Shaft 34 is one arm of a lever 37 pivotally mounted via pivot pin 38 and secured thereto by nut 39 and washer 40. As shown in FIG. 3, a spacer 41 surrounds pin 38 and spaces level 37 from side wall 33.

Lever 37 includes a camming portion 42 surrounding rod 21 as shown in FIG. 5. When button 15 is moved downwardly in FIG. 5 against the bias of spring 36, lever 37 moves in the direction of arrow 43 allowing rod 21 to cam about tip 44 of lever 37 to the FIG. 6 position. This moves end 45 of rod 21 downwardly in the direction of arrow 46 of FIG. 4 permitting the end thereof connected to rod 23 to move upwardly in the direction of arrow 47. This moves member 16 up through cylinder 24 to the dotted line position of FIG. 1 and the position shown in FIG. 7. It can be appreciated that pushing member 16 downwardly in the direction of arrow 48 in FIG. 7 cams end 45 of rod 21 about the camming surface 49 of lever 37 (FIG. 6), about point 44 and into the final camming portion 42 of lever 37 as shown in FIG. 5.

Thus, in operation, with device 11 installed as shown in FIG. 1 and the components thereof on the FIG. 4 position, door 13 can be opened and closed freely. If an intruder approaches door 13 and steps on button 15, end 45 of rod 21 is moved downwardly in the direction of arrow 46 in FIG. 4 against the bias of spring 36 until end 45 snaps about point 44 of lever 37 from the FIG. 5 to the FIG. 6 position. The other end of rod 21, fixed to piston rod 23, moves rod 23 upwardly in the direction of arrow 47 (FIG. 4), biased upwardly by spring 28, enabling integral door impeding member 16 to move out of housing 18 to the dotted line position of FIG. 1. In this position, door 13 cannot be opened inwardly in the direction of arrow 14 since it will abut against member 16.

Figure 7:
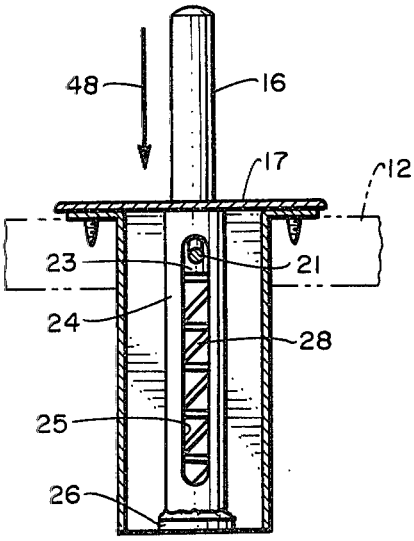
FIG. 7 is a view taken along lines VII—VII of FIG. 4 illustrating another position of the parts thereof.

By merely pushing member 16 downwardly against the bias of spring 36, and in the direction of arrow 48 as shown in FIG. 7, rod end 45 cams about camming surface 49 of lever 37 (FIG. 6) until end 45 moves into the camming portion 42 of lever 37, as shown in FIG. 5, thus locking therein until released by reactuation of button 15.

It can be seen that there has been disclosed apparatus and device which can be quickly and easily installed in a door opening to prevent unauthorized opening of the door by an intruder. The device can be quickly and easily reset for subsequent use.

Previously the discussion has centered around on intruder's actuation of the device of this invention, especially for doors that open outwardly.

Figure 8:
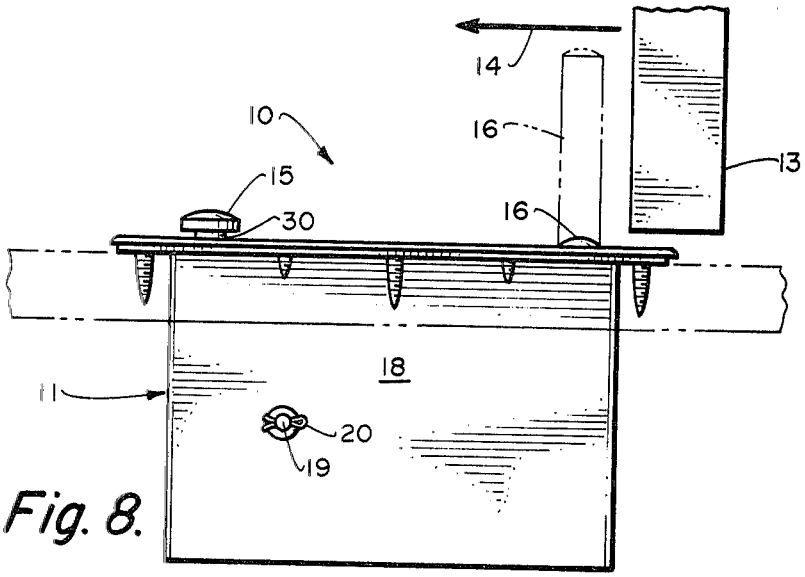
FIG. 8 is a schematic view, partly in cross-section, of the device of this invention installed in a doorway where the door opens inwardly.

This device can also be used inside of the home for entry door that open inwardly. To do so, the device could be recessed into the entry floor with plate 17 preventing it from falling into the cutout. For this type of operation the door, instead of being placed intermediate impeder 16 and actuator button 15, would be beyond the impeder 16 as is shown in FIG. 8. Since the device would be on the inside of the house, there would be no reason to conceal it. But of course one is free to do so with a rug.

The operation of the device as depicted in FIG. 8 could be carried out by the homeowner intentionally, rather than by the intruder accidentally. The lady of the house can use the device to prevent entry of undesired persons even after opening the door a bit to determine whom the party is, should she not have a peep sight built into the door. Also the use of the device per FIG. 8 allows the homeowner to keep the door slightly ajar to accept newspaper, certified mail and other small packages with complete peace of mind. Note specifically the different location of apparatus 10 with respect to door 13 per FIG. 1 where the intruder activates the device to prevent inward opening versus FIG. 9 where the homeowner activates the device to prevent inward opening.

Figure 9:
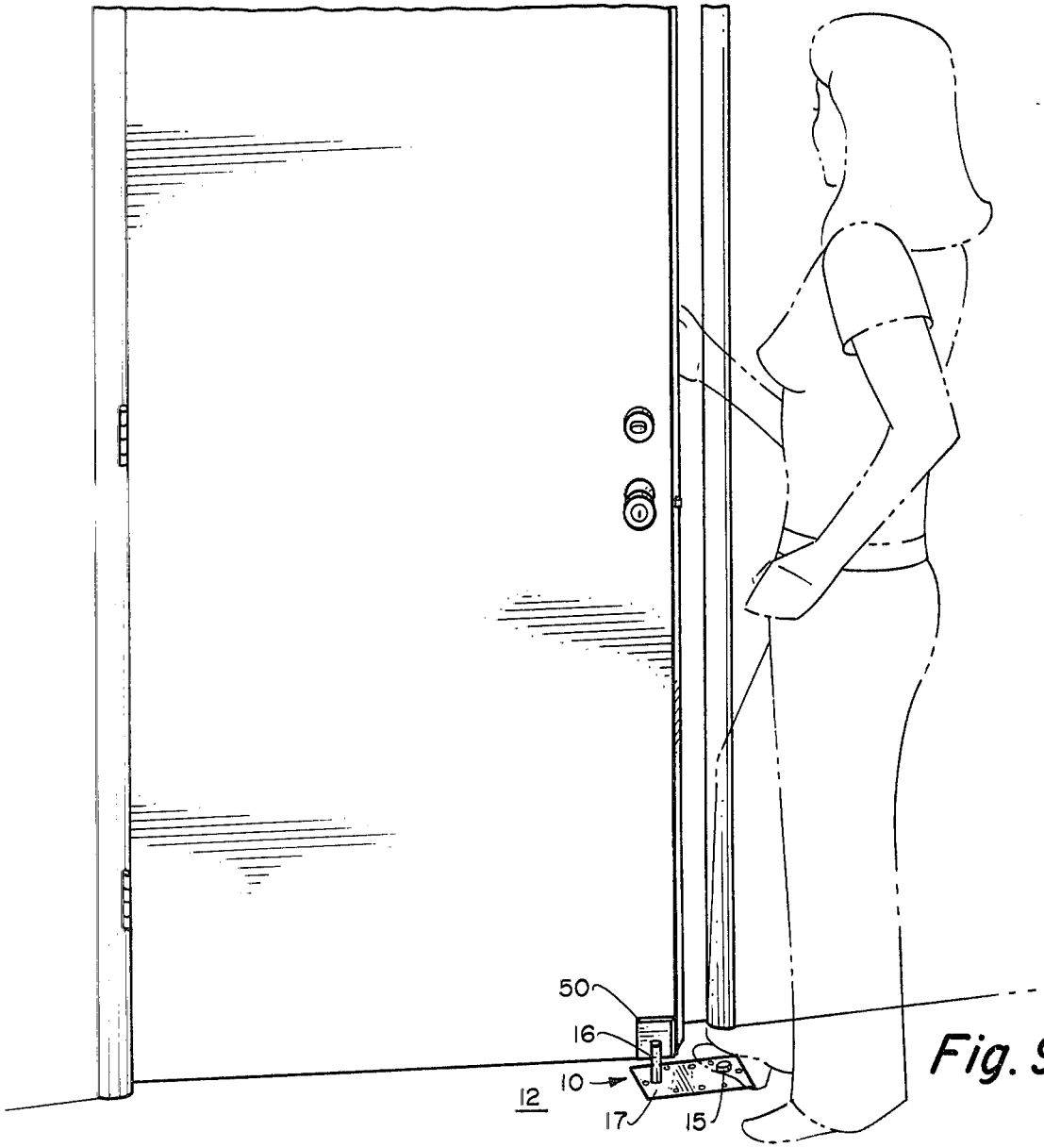
FIG. 9 is a diagrammatic sketch showing the device of this invention being employed.

It should also be appreciated that the relative placement of FIG. 1 can also be used for exteriorly opening doors where the device is activated by the homeowner. However, most building codes prohibit such doors except for screen and storm doors. While the device is operable in such situations, it is possible to thwart its effectiveness and its use is not recommended for this type of situation. Interior use per FIGS. 8 & 9 is preferred.

Though not actually required, it is preferred that a small square or rectangular striker plate, made of metal or high impact resistant plastic such as Lexan® be mounted at the bottom of the door at the point of impact with impeding member 16 to protect the door from disfigurement or discoloration. Reference is made to FIG. 9 which shows the device of this invention in operation with impeding member 16 adjacent striker plate 50, whereby the lady of the house can still receive small packages or mail through the opening between the door and the frame.

I claim:

1. A device for preventing unauthorized opening of a door comprising:

a housing;

a top plate closing off one end of said housing;

a button extending through an opening in said top plate having a first portion substantially flush with said top plate and a second portion extending through said opening in said top plate and into the interior of said housing;

a door stop member having a first portion normally disposed within the interior of said housing; and door stop member actuating means coupled to both said stop member and said button for normally retaining the first portion of said stop member within the interior of said housing and releasing the first portion of said stop member, upon actuation of said button, so that said first portion of said stop member moves out of the interior of said housing wherein said actuating means includes a cross rod having a first end fixedly secured to said stop member and a second end engaging button actuating means abutting against said button, and wherein said actuating means also includes an actuating lever pivotally mounted in said housing, said lever including a first end abutting said second portion of said button and a second end engaging said second end of said cross rod.

2. In the device of claim 1 wherein said second end of said lever includes a camming portion normally retaining said second end of said cross rod therein when said door stop member is normally disposed within the interior of said housing.

3. In the device of claim 2 including spring biasing means associated with both said second portion of said button and said first end of said lever normally biasing said button in a direction away from said lever.

4. In the device of claim 3 wherein said stop member includes an integral piston movable within a cylinder mounted on said housing, said cylinder including a slot with said first end of said cross rod movable therealong.

5. In the device of claim 4 wherein said piston is spring biased in a direction moving said stop member out of said housing.

6. In the device of claim 5 wherein said lever includes camming means on the second end of said lever adapted to cam said second end of said cross rod into said camming portion when said piston is moved against the bias of its spring.

7. Apparatus for preventing unauthorized opening of a door including a door opening, a door closing off said door opening, a floor below said door, said apparatus including a device for permitting normal opening and closing of the door while preventing opening of the door when actuated, said device comprising:

a housing mounted in said floor below said door opening:

a top plate closing off the upper end of said housing substantially flush with said floor;

a button extending through an opening in said top plate having a first portion substantially flush with said top plate and a second portion extending through said opening in said top plate and into the interior of said housing, said button extending through said opening of said top plate on a portion of said top plate on the side of said door, when said door normally closes said door opening, opposite the direction of opening of said door;

a door stop member having a first portion normally disposed within the interior of said housing with said first portion of said stop member adapted to extend out of the interior of said housing on the side of said door, when said door normally closes said door opening, in the direction of opening of said door; and door stop member actuating means coupled to both said stop member and said button for normally retaining the first portion of said stop member within the interior of said housing and releasing the first portion of said stop member, upon actuation of said button, so that said first portion of said stop member moves out of the interior of said housing into the path of movement of said door so that further movement of said door is prevented wherein said member actuating means includes a cross rod having a first end fixedly secured to said stop member and a second end engaging button actuating means abutting against said second portion of said button and wherein said actuating means includes an actuation level pivotally mounted in said housing, said lever including a first end abutting said second portion of said button and a second end engaging said second end of said cross rod.

8. An apparatus for preventing undesired opening of a door, including a door opening, a door closing off said door opening, said door opening in an inwardly direction, a floor positioned interiorly from said door opening, said apparatus including a device for permitting normal opening and closing of said door while preventing opening of the door when actuated, said comprising;

a housing mounted in said floor spaced interiorly from said door opening;

a top plate closing off the upper end of said housing substantially flush with said floor;

a button extending through an opening in said top plate having a first portion substantially flush with said top plate and a record portion extending through opening in said top plate and into the interior of said housing; said button being distal from the interior side of said door; and a door impeding member having a first portion normally disposed within the interior of said housing with said first portion of said step member adapted to extend out of the interim of said housing proximal the interior side of said door; and door impeding member activator means coupled to both said impeding member and said button for normally retaining the first portion of said impeding member within the terms of said housing and releasing the first portion of said impeding member upon activation of said button, whereby said first portion of said impeding member exits the interior of said housing into the path of evolvement of said door to impede the inwardly opening of said door, wherein said member activator means includes a cross rod having a first end fixedly secured to said stop member and a second end engaging button actuating means abutting against second portion of said button and wherein said activator means includes an actuating lever pivotally mounted in said housing, said lever including a first end abutting said second portion of said button and a second end engaging said second end of said cross rod.

* * * * *